US005132196A

United States Patent [19]

Hirayama et al.

[11] Patent Number: 5,132,196

[45] Date of Patent: Jul. 21, 1992

[54] PHOTOSENSITIVE MEMBER HAVING A COLORED ALUMINUM OXIDE LAYER

[75] Inventors: Junya Hirayama, Amagasaki; Yasuyuki Nomura; Fumio Masuda, both of Sakai, all of Japan

[73] Assignee: Minolta Camera Kabushiki Kaisha, Osaka, Japan

[21] Appl. No.: 573,718

[22] Filed: Aug. 28, 1990

[30] Foreign Application Priority Data

Aug. 29, 1989 [JP] Japan ..... 1-222299
Aug. 29, 1989 [JP] Japan ..... 1-222300

[51] Int. Cl.[5] ..... G03G 5/10

[52] U.S. Cl. ..... 430/63; 430/65; 430/526

[58] Field of Search ..... 430/65, 60, 61, 62, 430/63, 526

[56] References Cited

U.S. PATENT DOCUMENTS 2,635,962 4/1953 Nadeau et al. ..... 430/526
3,684,548 8/1972 Contois ..... 430/61
4,853,093 8/1989 Brenk et al. ..... 430/526

FOREIGN PATENT DOCUMENTS 58-100138 6/1983 Japan .

*Primary Examiner*—John Goodrow
*Attorney, Agent, or Firm*—Burns, Doane, Swecker & Mathis

[57] ABSTRACT

The present invention relates to an electrophotographic sensitive member having a photosensitive layer superimposed on an aluminum substrate having an aluminum oxide layer improving the color reproducibility of specific colors' wherein the aluminum oxide layer is colored to have specific maximum absorption wavelength.

6 Claims, 4 Drawing Sheets

PHOTOSENSITIVE MEMBER HAVING A COLORED ALUMINUM OXIDE LAYER

BACKGROUND OF THE INVENTION

1. Field of the Invention

The present invention relates to a photosensitive member that improves the color reproducibility of specific colors, and more specifically relates to a photosensitive member that improves the reproducibility of red and blue colors.

2. Description of the Related Art

Photosensitive members used in electrophotographic processes must have excellent reproducibility of certain colors. That is, normal business documents are most often produced in black, with red and blue being the next most frequently used colors, so that when copies of the such business documents are made, the reproducibility of the aforesaid specific colors must be particularly sharp in comparison to that of other colors.

In general, the spectral sensitivity of conventional photosensitive members is determined by the pigments used in the charge generating layer. Thus, methods that mechanically correct the spectrum of the exposure system are used to correct spectral sensitivity. Therefore, filters must be provided in the exposure optical path, and mirrors and lenses are. required for mechanical correction of spectral sensitivity, thereby incurring the disadvantage of increased cost.

As described above, it is desirable to change the spectral sensitivity of the photosensitive member without modifying the materials used in the photosensitive layer.

Examples of technologies related to the aforesaid technology are well known, although the objects differ, such as a photosensitive member provided a coating of red colored soluble nylon or the like as a protective overcoat layer (Japanese Patent Application No. 7 62-206560), and a photosensitive member comprising a substrate and photosensitive layer having an intermediate layer disposed therebetween comprising red colored acrylic and melamine resin (Japanese Patent Application No. 60-220356).

The technology disclosed in the aforesaid Japanese Patent Application No. 62-206560, however, presents a disadvantage inasmuch as filter effectiveness may be reduced through wear of the protective overcoat layer, and when a binder resin is incorporated in the photosensitive layer to disperse the coloring agent in a solution wherein the resin has been taken into solution by means of a solvent, there is the concern that said binder resin may be adversely affected by the solvent.

Further, the technology disclosed in the previously mentioned Japanese Patent Application No. 60-220356 presents concern that the intermediate layer disposed between the substrate and photosensitive layer may be adversely affected by solvent during the application of said photosensitive layer.

SUMMARY OF THE INVENTION

An object of the present invention is to provide a photosensitive member having improved reproducibility of specific colors and which eliminates the previously described disadvantages.

A further object of the present invention is to provide a photosensitive member having improved reproducibility of red or blue colors.

These and other objects are accomplished by the photosensitive member of the present invention having the construction described hereinafter.

More specifically, the present invention is an electrophotographic photosensitive member having a photosensitive layer superimposed on an aluminum substrate, said electrophotographic photosensitive member being characterized by having an aluminum oxide layer formed as a surface layer on a substrate, said aluminum oxide surface layer being colored by a coloring agent having a maximum absorption wavelength of 570 nm or more.

From another standpoint the present invention is an electrophotographic photosensitive member having a photosensitive layer superimposed on an aluminum substrate, said electrophotographic photosensitive member being characterized by having an aluminum oxide surface layer formed on an electrically conductive substrate, said aluminum oxide surface layer being colored by a coloring agent having a maximum absorption wavelength of 500 nm or less.

BRIEF DESCRIPTION OF THE DRAWINGS

In the following description, like parts are designated by like reference numbers throughout the several drawings.

DETAILED DESCRIPTION OF THE INVENTION

Figure 1:
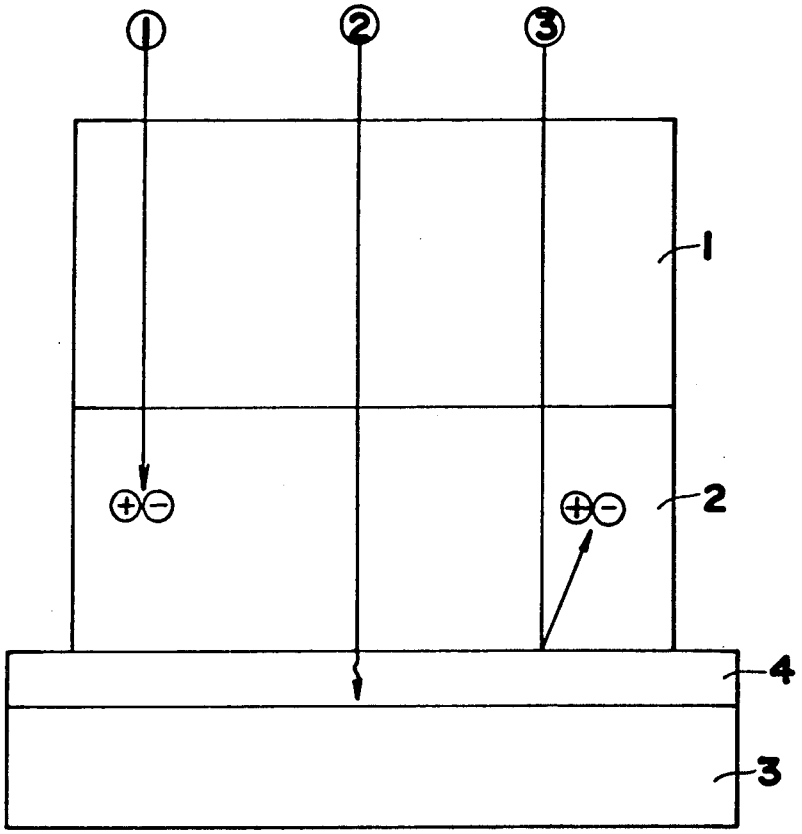
FIG. 1 is an illustration describing the why the photosensitive member having a colored aluminum oxide layer of the present invention provides excellent reproducibility of incidence rays of specific wavelengths.

The photosensitive member of the present invention having a colored aluminum oxide layer with a maximum light absorbency of a specific wavelength may have the construction described in the example below.

That is, the aforesaid photosensitive member is a photosensitive member provided a photosensitive layer superimposed on a substrate having aluminum as the main component, said photosensitive member being constructed with a surface layer of aluminum oxide formed on the aforesaid substrate wherein said aluminum oxide surface layer is colored by a coloring agent having a maximum absorption wavelength of a specific wavelength.

The use of a coloring agent having a maximum absorption wavelength of a specific wavelength means that light absorption in the vicinity of the aforesaid specific wavelength is relatively greater than light absorption in the wavelength region outside the specified wavelength.

In the present invention, an aluminum oxide surface layer on an aluminum substrate (anodized aluminum process) can be obtained by, for example, anodizing the surface layer within an acidic solution of oxalic acid, sulfuric acid and the like. The adhesive properties between the substrate and photosensitive layer can be improved and penetration of electric charge from the substrate to the photosensitive layer can be prevented by subjecting the substrate surface layer to an anodizing process.

An aluminum oxide layer obtained in the manner previously described has a multicellular structure with a plurality of micropores formed in the surface layer portion. The colored aluminum oxide layer of the present invention can be obtained by filling the aforesaid micropores with a coloring agent.

The thickness of the aluminum oxide layer formed on the aforesaid surface layer is not specifically restricted, but may be 1 to 1,000 μm.

Pigments or dyes are most suitable for use as the previously mentioned coloring agents, and colors can be produced by the manufacturing methods described hereinafter.

First, the use of dyes as coloring agents is described. Although there are a number of conditions which vary when dyes are used as coloring materials, in general, a substrate having an aluminum oxide layer with micropores as previously described, is immersed in an aqueous solution containing a dye at a concentration of 0.01 to 10 g/l so as to color said substrate. Colorizing suitable for the present invention can be accomplished by an immersion process lasting 2 to 40 min wherein the aforesaid aqueous solution is maintained at a temperature of 30° to 65° C. When an image forming process is performed by an electrophotographic process using a photosensitive member obtained by the method described above with a dye temperature higher than that described in the aforesaid conditions, spots are produced on the image which are thought to be caused by charge injection from the substrate. Furthermore, when the dye temperature is lower than that described in the aforesaid conditions, the absorption of the dye is inadequate.

Colorizing using pigments is hereinafter described. When pigments are used, a solution containing the pigment and a solvent is formed by dissolving the aforesaid pigment used for coloring in a suitable solvent in which said pigment is soluble, and immersing substrate having an aluminum oxide layer within the aforesaid solution to color said substrate. In general, colorizing with pigments is accomplished under identical conditions to those described previously for colorizing with dyes.

Subjecting the colored aluminum oxide layer obtained by the previously described manufacturing methods to a sealing treatment is desirable.

The coloring agent is prevented from separating out of the micropores by means of the aforesaid sealing treatment, thereby preventing any adverse affect between the photoconductive layer and substrate. That is, the characteristics of the photosensitive member remain stable, and rises in residual potential during repeated use and dispersion of the initial charging characteristics, as well as fluctuation in electrophotographic properties over time can prevented.

Sealing treatment methods suitable for the present invention will accomplish sealing, for example, by heating a nickel acetate aqueous solution to about 40° to 80° C. and immersing the substrate therein for a period of 5 to 30 min, or by immersion in water vapor for about 10 to 30 min at a pressure of 3 to 5 atmospheres, or by boiling in desalinated water for about 30 min.

Further, the sealing treatment preferably will achieve a resistance value for the colored aluminum oxide layer such that a measured impedance value of 5 K to 100 KΩ will be obtained according to the ALCOA standard.

Specific examples of useful types of coloring agents are described hereinafter. For the reasons previously described, the aforesaid aluminum oxide layer is colored using a blue or green dye or pigment to improve red color reproducibility of the photosensitive member of the present invention. These dyes and pigments are coloring agents having a maximum absorption wavelength of 570 nm or greater.

Examples of coloring agents are listed below.

PIGMENTS

Iron Blue (Orient Chemicals Co., Ltd.) Alkali Blue Lake (Sherwin-Williams Chemicals), Victoria Blue Lake (H. Kohnstamm & Co., Inc.), Phthalocyanine Blue (Hilton-Davis Chemical Co., Ltd.), Fast Sky Blue (Toyo Co., Ltd.), Indanthrene Blue BCF (GAF Corporation), Cromal Green N (New York Color & Chemical Co.), Pigment Green B (Reeves & Sons, Ltd.), Malachite Green Lake (H. Kohnstamm & Co., Inc.) and the like.

DYES

Sandolan Blue E-2AL (Sandoz, Ltd.), Sandolan Blue E-SEL (Sandoz, Ltd.), Sandolan Blue E-BL (Sandoz, Ltd.), Sandolan Blue P-ARL (Sandoz, Ltd.), Methylene Blue (Buffalo Color Corporation), Ultramarine Blue (BASF Aktiengesellschaft), Azo Dark Green GC (Sandoz, Ltd.), Erionyl Green 3B (Ciba-Geigy Corporation), Brilliant Green (Ciba-Geigy Corporation) and the like.

An explanation of how the photosensitive member of the present invention improves blue color reproducibility follows hereinafter. In this case the previously described aluminum oxide layer is colored by a red dye or pigment. These dyes and pigments are coloring agents having a maximum absorption wavelength of 500 nm or less.

Examples of coloring agents are listed below.

DYES

Solar Flavine RN (Sandoz, Ltd.), Sandolan Yellow E-TZ (Sandoz, Ltd.), Sandolan Yellow E-RPL (Sandoz, Ltd.), Aizen Opal Yellow 3GH (Hodogaya Chemical Co., Ltd.), Vitrolan Yellow GR (Sandoz, Ltd.), Neolan Orange G (Ciba-Geigy S.A.), Aluminum Gold Orange RLW (Sandoz, Ltd.), Quinoline Yellow (Aktiengesellschaft für Anilin-Fabrikatio), Sicomet Rose Bengale S (BASF Aktiengesellschaft) and the like.

PIGMENTS

Chrome Yellow (Dainippon Seika Co., Ltd.), Zinc Yellow (Nippon Mukikagaku Co., Ltd.), Cadmium Yellow (Dainippon Ink & Chemicals, Inc.), Mineral Yellow C (Compagnie Francaise des Extraits Tinctoriaux et Tannants au Havre), Nickel Titan Yellow (Ferro Corporation), Naphthol Yellow S (Sumitomo Chemicals Co.), Versal Yellow G (Chemapol, Prague, Czechoslavakia Industrial Chemistry), Benzidine Yellow G (Amar Dye-Chemical, Ltd.), Benzidine Yellow GR (Industrial Delta SAIC), Permanent Yellow NCG (Industrial Delta SAIC), Molybdate Orange (Hilton-Davis Chemical Co.), Pyrazolone Orange NP215 (Pigmentos Y Oxidos S.A.), Indanthrene Brilliant Orange RK (GAF Corporation), Benzidine Orange G (Amar Dye-Chemical, Ltd.), Iron Oxide Red (Toyo Shikiso Company), Cadmium Red (Dainippon Ink & Chemicals, Inc.), Red lead (Dainippon Toryo Co.), Permanent Red 4RS (Industrials Delta SAIC), Permanent Red 2B (Hilton-Davis Chemical Co.), Lake Red D (Ridgeway Color & Chemical Division), Brilliant Carmine 6B (Toyo Co., Ltd.), Brilliant Carmine 3B (Kaseihin Kogyo Kyokai), Rhodamin B (BASF Aktiengesellschaft), Alizarine Lakes (H. Kohnstamm & Co., Inc.), Eosine Lake (Dainippon Ink & Chemicals, Inc.) and the like.

Modes of photosensitive layers applicable to the present invention are described hereinafter. In the present invention, the photosensitive layer may be a monolayer type layer or a function-separated type having a charge generating layer and charge transporting layer. In the case of a function-separated type layer, the sequence of the lamination layers comprising a charge generating layer and a charge transporting layer is not specified, however, a preferred mode for the present invention is that a charge generating layer be superimposed directly on a substrate having the colored aluminum oxide layer of the present invention, and a charge transporting layer be superimposed on the aforesaid charge generating layer. The aforesaid mode is preferred because it allows the charge generating layer to more effectively receive light reflected by the substrate, which is an object of the present invention and accomplishes marked improvement of the reproducibility of specific colors. Details of the aforesaid improvement are described hereinafter.

Examples of useful photosensitive materials applicable to the photosensitive layer of the present invention are inorganic materials such as Se compounds, CdS compounds and α-Si compounds, or organic materials such as phthalocyanine compounds and the like. The aforesaid materials may be laminated on a substrate by a vapor deposition method, or may be applied as a coating dispersed in a binding resin having film forming properties.

Further, conventional charge generating layers and charge generating layers are applicable to the aforesaid function-separated type photosensitive layer. That is, each type of photosensitive organic pigment can be used to form a laminate layer by vapor deposition, or a coating method wherein said pigment is dispersed in a binder resin to form a charge generating layer.

Examples of usable organic pigments are each type of azo pigment, perylene, phthalocyanine, polycyclic quinone, indigo, quinacridone and the like. In the formation of a charge generating layer by the previously mentioned coating method, a binder resin is dissolved in a suitable solvent and the aforesaid pigment is added thereto at a rate of 10 to 200 parts by weight (pbw) per 100 pbw of binder resin and dispersed by a method using a ball mill or sand mill or the like, then the resulting solution is applied as a coating with a thickness of 0.1 to 1 μm. Further, the aforesaid charge transporting layer can be formed by plasma vacuum deposition of an amorphous carbon film, or an electron donor material comprising a derivative of hydrazone, pyrazoline, triphenylmethane, oxidiazole, carbazole, styryl, imidazole and the like, or an electron receptor material such as trinitrofluoronone, tetranitroxanthone, tetracianoethylene, tetracianoquinodimethane and the like can be used ca to dissolve a charge transporting material in a resin having film forming properties and applying the resulting solution as a coating having a thickness of 5 to 30 μm.

Examples of binder resins useful for the aforesaid charge generating layer and charge transporting layer are polyester, polycarbonate, polymethacrylate esters, polyvinyl butyral, silicone resin, epoxy resin, melamine resin, urethane resin, polystyrene and the like.

An explanation as to why the photosensitive member of the present invention provides excellent reproducibility of specific colors follows hereinafter.

FIG. 1 shows a function-separated type photosensitive member of the present invention having superior reproducibility of red color wavelength when used for normal developing.

That is, the surface layer of aluminum substrate 3 is formed by an aluminum oxide layer 4 colored with a blue coloring agent, said aluminum oxide layer 4 having a charge generating layer 2 and a charge transporting layer 1 sequentially superimposed thereon.

Incidence light 1 penetrates into charge generating layer 2, and is the light that generates carriers within the aforesaid layer. On the other hand, incidence rays 2 and 3 are transmitted through both charge transporting layer 1 and charge generating layer 2 and reach aluminum oxide layer 4. Incidence light 2 is the transmitted light in the range of red color wavelength, and incidence light 3 is the transmitted light in the blue color wavelength range.

Aluminum oxide layer 4 is colored by a blue coloring agent. Accordingly, the aforesaid incidence light 2 is absorbed into aluminum oxide layer 4. On the other hand, incidence light 3 is not absorbed and is therefore reflected by the surface of layer 4 to the interior region of charge generating layer 2.

The reflected light 3 reflected in the aforesaid manner penetrates into layer 2 and again generates carriers, while incidence light 2 is absorbed by layer 4 and therefore does not generate carriers. The aforesaid situation results in a differential between the carrier generating efficiency in the coloring agent light absorption region and the carrier generating efficiency outside said light absorption region. Only incidence light 2 in the red color range has a low carrier generating efficiency compared to light of other wavelengths. Therefore, when the previously described photosensitive member is used in normal developing methods, photosensitivity is reduced in the red color wavelength range without reducing the initial charging potential compared to that of light at other wavelengths. Accordingly, more of the photosensitive member receives incidence light in the red color range than other incidence light and developing material adheres thereto. Thus, red color reproducibility is improved. Further, blue color reproducibility is improved when the previously described photosensitive member is used in reverse developing methods. The reasons for the improved blue color reproducibility are obvious from the foregoing explanation.

As has been clearly shown in the foregoing description, carrier generation or non-generation is determined by the presence or absence of reflected light 3 reflected form the substrate. Accordingly, it is desirable that reflected light 3 have greater presence in the charge generating layer. That is, in the case of a laminate layer type photosensitive member, it is preferable that the charge generating layer be directly superimposed on the substrate with a charge transporting layer laminated over said charge generating layer.

Figure 2:
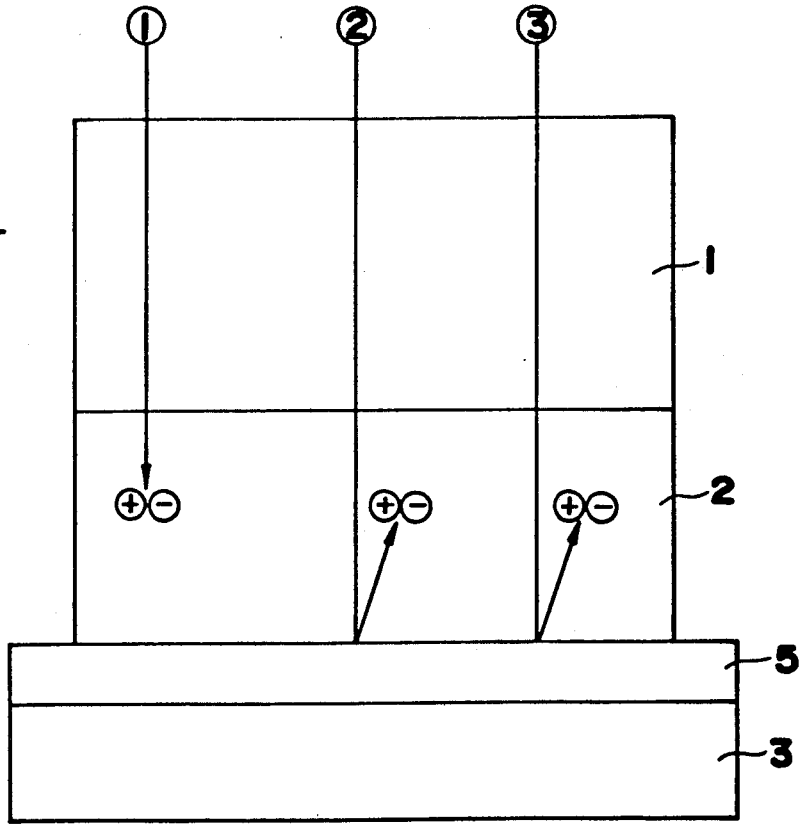
PRIOR ART FIG. 2
FIG. 2 is a comparative illustration of FIG. 1.

In contrast, a photosensitive member having a simple, uncolored aluminum oxide layer 5 is shown in FIG. 2. In this case there is no improvement in the reproducibility of specific colors because differences in light reflection and absorption are not produced by incidence rays of different wavelengths.

Further, when using the photosensitive member in a normal developing method, the aluminum oxide layer 4 may be colored by a red coloring agent to improve blue color reproducibility, as can be readily understood from the preceding explanation.

Examples follow which illustrate the degree to which photosensitivity of the photosensitive member is influenced by the degree of light absorbency of the coloring agents used to color aluminum oxide layer 4.

Figure 3:
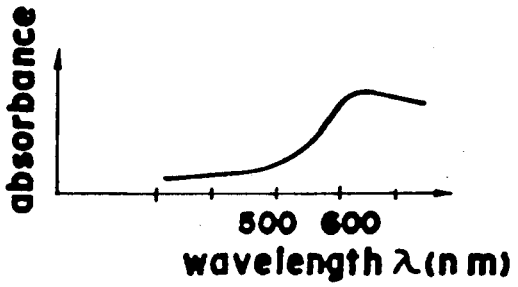
FIGS. 3 and 6 are graphs showing the correspondence between wavelength and absorbency of the coloring agents used in the present invention.

FIG. 3 illustrates the relationship between wavelength and light absorption of blue coloring agents. That is, FIG. 3 illustrates examples of coloring agents having maximum absorption wavelengths of 570 nm and greater.

Figure 4:
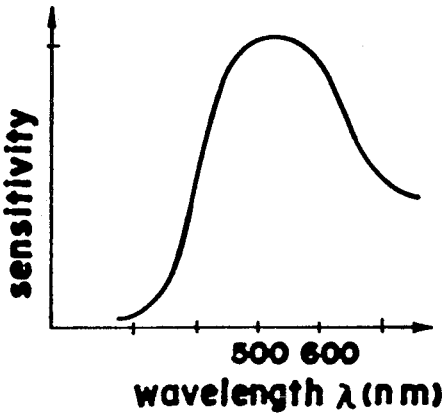
FIG. 4 shows the relationship between wavelength and sensitivity of the photosensitive member having a colored aluminum oxide layer.
Figure 5:
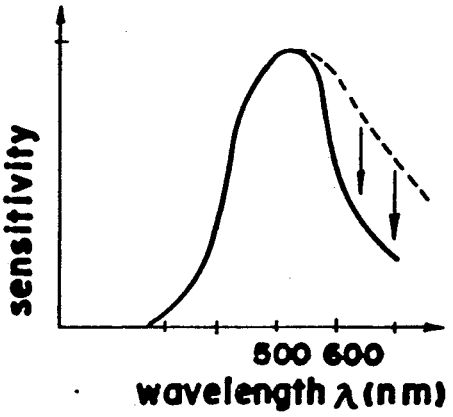
FIGS. 5 and 7 are graphs showing the relationship between wavelength and sensitivity of the photosensitive member having an aluminum oxide layer colored by the coloring agents shown in FIGS. 3 and 6.

FIGS. 4 and 5 illustrate the difference in photosensitivity between colored photosensitive members and non-colored photosensitive members, to wit, FIG. 4 shows the photosensitivity of a photosensitive member lacking an aluminum oxide layer on the substrate surface, while FIG. 5 shows the photosensitivity of a photosensitive member provided with an aluminum oxide layer colored by the coloring agent shown in FIG. 3. It is to be understood from the illustrations that photosensitivity is markedly reduced in the range above 570 nm.

Figure 6:
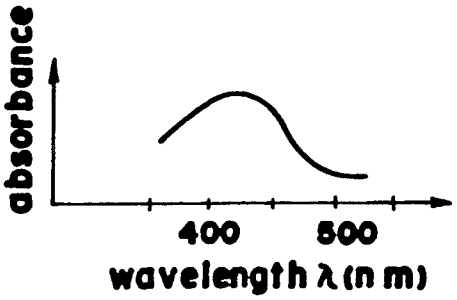
Figure 7:
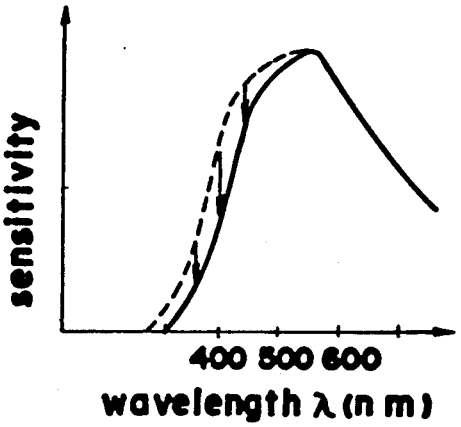

Similarly, FIG. 6 shows the relationship between wavelength and light absorption of red coloring agents. That is, FIG. 6 shows an example of a coloring agent having a maximum absorption wavelength of 500 nm or less. FIG. 7 shows the photosensitivity of a photosensitive member colored the aforesaid coloring agent. It is to be understood from the drawings that photosensitivity is markedly reduced in the range below 500 nm compared the uncolored photosensitive member of FIG. 4.

The present invention is described in detail hereinafter by means of specific examples. It is to be understood that the present invention is not limited to the examples described below.

EXAMPLE 1

An aluminum member was subjected to surface processing by a lathe machining process and used as a substrate, said surface having formed thereon an aluminum oxide layer of about 6 μm in thickness in an electrolytic bath containing 15% by volume of sulfuric acid at a temperature of about 20° C.

Figure 8:
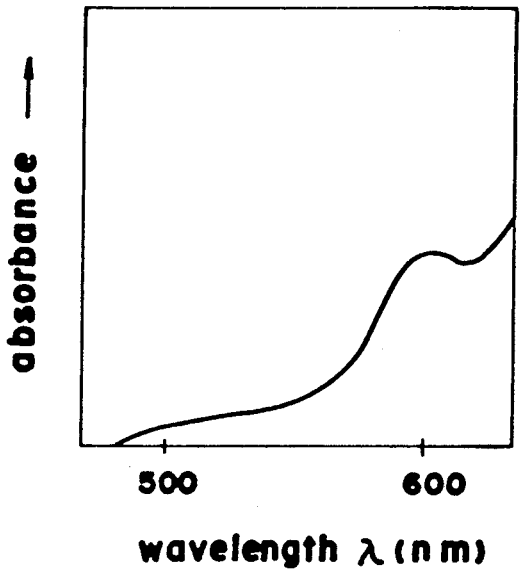
FIGS. 8 and 9 illustrate the relationship between wavelength and absorbency of the coloring agents used in the examples.

After the aforesaid substrate was rinsed in water, it was immersed in a coloring solution containing a blue dye, which has the spectral absorption characteristics shown in FIG. 8, dissolved in water, then dried so as to form an aluminum oxide layer.

Then, after a sealing process, the substrate was coated with a solution comprising a bisazo pigment (1 pbw), polycarbonate resin (1 pbw) and tetrahydrofuran (98 pbw), said coating was then dried so as to obtain a charge generating layer of 0.5 μm in thickness. The charge generating layer was then coated with a solution comprising a hydrazone compound (10 pbw), polycarbonate resin (10 pbw) and dichloromethylene (80 pbw) which was dried to form a charge transporting layer having a thickness of 20 μm, thereby producing a laminate layer photosensitive member.

EXAMPLES 2 THROUGH 4

Laminated photosensitive members were produced in the same manner as described in Example 1, with the exception that the aluminum oxide layers were 10 μm (Example 2), 14 μm (Example 3), and 20 μm (Example 4) respectively.

EXAMPLE 5

An aluminum member was subjected to surface processing by a lathe machining process and used as a substrate, said surface having formed thereon an aluminum oxide layer of about 12 μm in thickness in an electrolytic bath containing 15% by volume of sulfuric acid at a temperature of about 20° C.

Figure 9:
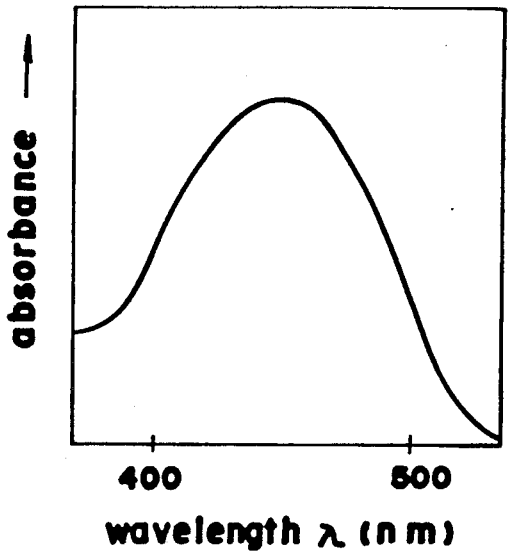

After the aforesaid substrate was rinsed in water, it was immersed in a coloring solution containing a red dye (Orient Chemical Co., Ltd.; Alfast Yellow 5101), which has the spectral absorption characteristics shown in FIG. 9, dissolved in water, then dried so as to form an aluminum oxide layer. The member was dyed until a to saturated concentration was achieved.

Then, after a sealing process, the substrate was coated with a solution comprising a bisazo pigment (1 pbw), polycarbonate resin (1 pbw) and tetrahydrofuran (98 pbw), said coating was then dried so as to obtain a charge generating layer of 0.5 μm in thickness. The charge generating layer was then coated with a solution comprising a hydrazone compound (10 pbw), polycarbonate resin (10 pbw) and dichloromethylene (80 pbw) which was dried to form a charge transporting layer having a thickness of 20 μm, thereby producing a laminate layer photosensitive member.

REFERENCE EXAMPLE 1

A photosensitive member was produced in the same manner as described in Example 1, with the exception that the aluminum oxide layer was not colored.

REFERENCE EXAMPLE 2

A photosensitive member was produced in the same manner as described in Example 4, with the exception that the anodized aluminum layer was not colored.

Figure 10:
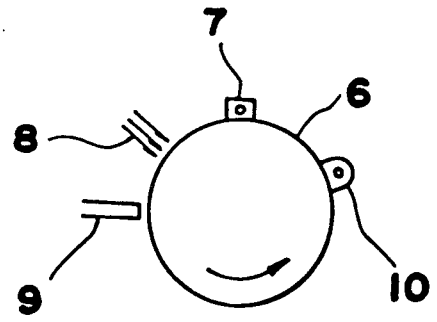
FIG. 10 is an illustration showing the tester for measuring the electrophotographic characteristics of the photosensitive member.

The electrophotographic characteristics of the photosensitive members obtained as described above in Examples 1 through 5 and Reference Example 1 were measured using the tester shown in FIG. 10. The results of the aforesaid measurements are shown in Table 1. The tester in FIG. 10 charges photosensitive member 6 by means of charger 7, exposes the surface of said photosensitive member 6 to light at exposure portion 8, and measure the surface potential thereof by means of a surface electrometer 9. Item 10 in the drawing is a discharge lamp.

Red or blue color reproducibility was tested using a model EP-3120 copying machine (Minolta Camera Co., Ltd.) and using a color test chart (Murakami Shikisai, K.K.) as the original document. In Examples 1 through 4 and Reference Examples 1 and 2, the color test chart copy density was measured at 602 nm, and in Example 5 and Reference Example 1 copy density was measured at 489 nm. The measurement results are shown in Tables 2 and 3.

The aforesaid measurement results clearly indicate that while initial characteristics and repeat characteristics are not dissimilar to those of Reference Examples 1 and 2, the colored photosensitive member of the present invention provides superior red color and blue color reproducibility.

The measured color characteristics of the aluminum oxide layers of Example 1 through 5 are shown in Table 4. The measurements shown in Table 3 were obtained using a model CR-100 colorimeter (Minolta Camera Co., Ltd.).

TABLE 1

| Electrophotographic Properties of Examples | | | | | | | |
|---|---|---|---|---|---|---|---|
| Examples | AM*1 Thickness (μm) | Initial Characteristics $V_0$ (V) | $E_{\frac{1}{2}}$ (1 · s) | $V_r$ (V) | $DDR_5$ (%) | Repeat*2 Characteristics $V_0 \rightarrow$(V) | $V_r \rightarrow$(v) |
| 1 | 6 | 502 | 2.4 | 11 | 3.5 | 500→495 | 11→11 |
| 2 | 10 | 504 | 2.6 | 10 | 2.7 | — | — |
| 3 | 14 | 505 | 2.4 | 9 | 2.5 | — | — |
| 4 | 20 | 514 | 2.6 | 11 | 2.9 | 500→495 | 11→11 |
| 5 | 12 | 500 | 2.5 | 11 | 2.5 | 500→490 | 11→11 |
| Ref 1 | 6 | 488 | 1.77 | 11 | 2.5 | 500→490 | 11→11 |
| Ref 2 | 20 | 505 | 1.79 | 11 | 3.1 | 500→492 | 11→11 |

(NOTE)
*1: Am indicates the aluminum oxide layer.
*2: "Initial characteristics" are characteristics those after 3,000 cycles.

Items $V_0$, $E_{\frac{1}{2}}$, $V_r$ and $DDR_5$ in Table 1 are defined as follows:

$V_0$: Initial surface electric potential $E_{\frac{1}{2}}$: Exposure required to reduce the initial surface potential to $\frac{1}{2}$ (units in lux/sec).

$V_r$: Residual potential $DDR_5$: Rate of decay of initial surface potential discharged in the dark (dark decay) for 5 seconds.

TABLE 2

| Red Color Reproducibility | | |
|---|---|---|
| Example | Am Thickness (μm) | 602 nm Copy Density*1 |
| 1 | 6 | 0.95 |
| 2 | 10 | 0.90 |
| 3 | 14 | 0.99 |
| 4 | 20 | 0.90 |
| Ref 1 | 6 | 0.80 |
| Ref 2 | 20 | 0.80 |

(NOTE)
*1: Macbeth densitometer was used.

TABLE 3

| Blue Color Reproducibility | |
|---|---|
| Examples | 489 nm Copy Density*1 |
| Ex 5 | 1.4 |
| Ref 1 | 1.2 |

(NOTE)
*1: Macbeth densitometer was used.

TABLE 4

| Color Characteristics | | | | |
|---|---|---|---|---|
| Example | Am Thickness (μm) | Degree of Coloration L | a | b |
| 1 | 6 | 51.5 | −17.7 | −46.5 |
| 2 | 10 | 46.5 | −12.5 | −46.2 |

TABLE 4-continued

| Color Characteristics | | | | |
|---|---|---|---|---|
| Example | Am Thickness (μm) | Degree of Coloration L | a | b |
| 3 | 14 | 41.8 | −7.1 | −44.0 |
| 4 | 20 | 35.6 | −1.2 | −39.8 |
| 5 | 12 | 30.2 | −15.9 | −25.2 |

Although the present invention has been fully described by way of examples with reference to the accompany drawings, it is to be noted that various changes and modifications will be apparent to those skilled in the art. Therefore, unless otherwise such changes and modifications depart form the scope of the present invention, they should be construed as being included therein.

We claim:

1. A photosensitive member for use in producing an electrostatic latent image thereon by exposing the photosensitive member to exposing light having a wavelength-range larger than the wavelength-range of from 500 to 570 nm, said photosensitive member comprising:
   a photosensitive layer having a sensitive wavelength-range larger than the wavelength-range of from 500 to 570 nm; and
   a substrate superposing the photosensitive layer, said substrate having an aluminum oxide layer on the surface thereof and being colored by a coloring agent having a maximum absorption wavelength of 570 nm or more wherein the intensity of the maximum absorption wavelength is greater than any absorption intensity of the substrate outside of the maximum absorption wavelength in the sensitivity wavelength-range.

2. A photosensitive member as claimed in claim 1 wherein said aluminum oxide layer has a thickness of 1 to 1,000 μm.

3. A photosensitive member as claimed in claim 1 wherein said coloring agent is dye and said aluminum oxide layer is treated by a sealing treatment after said aluminum oxide layer is colored by said dye.

4. A photosensitive member for use in producing an electrostatic latent image thereon by exposing the photosensitive member to exposing light having a wavelength-range larger than the wavelength-range of from 500 to 570 nm; said photosensitive member comprising:
   a photosensitive layer having a sensitivity wavelength-range larger than the wavelength-range of from 500 to 570 nm; and
   a substrate superposing the photosensitive layer, said substrate having an aluminum oxide layer on the surface thereof and being colored by a coloring agent having a maximum absorption wavelength of 500 nm or less wherein the intensity of the maximum absorption wavelength is greater than any absorption intensity of the substrate outside of the maximum absorption wavelength in the sensitivity wavelength-range.

5. A photosensitive member as claimed in claim 4 wherein said aluminum oxide layer has as a thickness of 1 to 1,000 μm.

6. A Photosensitive member as claimed in claim 4 wherein said coloring agent is dye and said aluminum oxide layer is treated by a sealing treatment after said aluminum oxide layer is colored by said dye.

* * * * *